US006557750B1

(12) United States Patent
Druse et al.

(10) Patent No.: US 6,557,750 B1
(45) Date of Patent: May 6, 2003

(54) PROMOTIONAL MAILING DEVICE

(75) Inventors: Donald R. Druse, Chicago, IL (US); Frank A. Colacino, Bartlett, IL (US); Robert A. Hovey, Jr., Chicago, IL (US)

(73) Assignee: Xtreme Traffic Builders, Inc., Chicago, IL (US)

( * ) Notice: Subject to any disclaimer, the term of this patent is extended or adjusted under 35 U.S.C. 154(b) by 0 days.

(21) Appl. No.: 10/107,634

(22) Filed: Mar. 27, 2002

(51) Int. Cl.[7] ..... B65D 3/04

(52) U.S. Cl. ..... 229/162; 206/37.1; 206/457; 229/74; 229/92; 229/93; 229/921

(58) Field of Search ..... 229/92, 93, 74, 229/921, 162; D9/418; 206/305, 320, 457, 37.1, 38.1; D13/168

(56) References Cited

U.S. PATENT DOCUMENTS

| | | | | | |
|---|---|---|---|---|---|
| 337,785 | A | * | 3/1886 | Pegg | 217/62 |
| 542,409 | A | * | 7/1895 | Fletcher | 229/92 |
| 739,232 | A | * | 9/1903 | Stafford | 229/93 |
| 744,176 | A | * | 11/1903 | Del Mar | 229/93 |
| 932,425 | A | * | 8/1909 | Ashley | 229/93 |
| 969,367 | A | * | 9/1910 | Hamilton | 229/93 |
| 1,032,282 | A | | 7/1912 | Hay | |
| 1,146,206 | A | * | 7/1915 | Quinlan | 229/93 |
| 1,473,393 | A | * | 11/1923 | Albertoni | 229/93 |
| 1,750,074 | A | | 3/1930 | Warner | |
| 2,079,177 | A | | 5/1937 | Membrino | |
| 2,118,262 | A | * | 5/1938 | McGrady et al. | 220/662 |
| 2,143,957 | A | * | 1/1939 | Petter | 229/122.32 |
| 2,176,955 | A | * | 10/1939 | Clow | 229/162 |
| 2,464,278 | A | | 3/1949 | Wilson | |
| 3,306,266 | A | * | 2/1967 | McCunney | 206/38.1 |
| 3,819,081 | A | | 6/1974 | Runte | |
| 4,915,287 | A | * | 4/1990 | Volk et al. | 229/70 |
| 5,220,319 | A | * | 6/1993 | Kendel | 340/825.69 |
| D367,226 | S | * | 2/1996 | Ransbottom | D9/418 |
| 5,873,456 | A | * | 2/1999 | Hull et al. | 206/38.1 |
| D441,185 | S | * | 5/2001 | Shimizu et al. | D3/207 |
| D441,524 | S | * | 5/2001 | Shimizu et al. | D3/207 |
| D448,157 | S | * | 9/2001 | Wright | D3/208 |
| D456,600 | S | * | 5/2002 | Gadson | D3/208 |

OTHER PUBLICATIONS

"Picture Perfect Direct Marketing" by Paul Piscitelli "Sales & Marketing Management" vol. 149, No. 8, p. 107, Aug., 1997.*

"The Road Not Taken" by Joanne Cleaver "Marketing News," vol. 34, No. 7, p. 1, Mar. 27, 2000.*

"Betting on a Blizzard" by Michael Klein "Leader–Telegram" Eau Claire, Wisconsin, Section D, p. 1, Dec. 10, 1995.*

"Promotion Times Online Newsletter," second edition–2000 [online] [retrieved on Feb. 10, 2003]. Retrieved from the Internet URL: http://www.scapromotions.com/newsletters/2000e2/page3.html.*

* cited by examiner

*Primary Examiner*—Stephen P. Garbe
(74) *Attorney, Agent, or Firm*—Edward J. Chalfie

(57) ABSTRACT

A direct mail package is provided. The package includes a transparent cylindrical tube with two press-fitted end caps. An enclosure certificate is folded along orthogonal fold lines to provide four plies. As folded, the length of the enclosure is substantially equal to the length of the tube and the height of the folded enclosure is greater than the diameter of the tube but less than the inside circumference of the tube. When the folded certificate is deformed to fit inside the tube, it conforms substantially to the inside curvature of the transparent tube. The exposed convex quadrant contains postal information visible through the transparent tube. The arc of the plane thus formed frames a gap between its opposite lineal edges. This gap frames a window allowing display of a promotional token inside the tube.

12 Claims, 4 Drawing Sheets

PROMOTIONAL MAILING DEVICE

FIELD OF THE INVENTION

This invention relates to direct mail promotional articles, and especially dimensional mailers including marketing insert materials.

BACKGROUND OF THE INVENTION

Direct mail articles are commonly used to attract potential customers to merchants such as automobile dealers and the like. They are mailed to demographically and geographically chosen likely buyers by the dealers themselves, or, more likely, by marketing service firms. The aim is to build and direct interested retail traffic into the dealers. Recent published studies, such as a 1993 study by Baylor University, cited by the Promotional Products Association International, found that the use of dimensional mailers can significantly improve response rates over flat direct mail alone. In addition, the study indicated that the packaging of promotional products in dimensional mailers can evoke curiosity as well as further increase direct mail response rates.

Traditional dimensional promotional mailers have certain drawbacks to their effectiveness. For example, a boxed item may be too heavy to be mailed at the lowest rate of first class postage. Further, recent events have caused people to be wary of unsolicited items received in the mail, especially bulky items which cannot be examined prior to opening.

The present invention provides a light weight, easily assembled, easily mailed package with a transparent window for the postal recipient to view the contents thereof. By this inspection, the recipient is both reassured of the safety of the package and intrigued by the promotional item therein.

In order to improve the favorable response rate from direct mail advertising and commercial solicitations, it is desirable to include a personalized response device containing the original addressee's name and address, and incentivizing the addressee to contact the sponsoring dealership or other business on a form that permits selection and confirmation of merchandise or services to be ordered. Typically, the personalized response device is in the form of a certificate for a discount or other incentive redeemable at the sponsoring retail dealer. In addition, the package may contain a game or promotional token which may have intrinsic value, extrinsic value, or both.

It is therefore an object of this invention to provide a direct mail article in the form of transparent semi-rigid mailing tube that is adapted to receive printed promotional materials and a promotional token, all of which can be self-mailed without a separate outer wrapper or envelope.

It is another object of this invention to provide a direct mail article in the form of transparent mailing tube that can be mailed without an outer wrapper or envelope, and that displays addressee, return address and postage information.

It is a further object of this invention to provide a direct mail article in the form of transparent mailing tube that can receive a promotional token which is readily displayed within the mailing tube.

Another object of the invention is to provide a object of this invention to provide a direct mail article in the form of transparent mailing tube having end caps to seal the ends of the tube during mailing but are readily removable by the intended addressee.

It is yet another object of this invention to provide object of this invention to provide a direct mail article in the form of transparent mailing tube having end caps to seal the ends of the tube during mailing and to display further promotional information.

SUMMARY OF THE INVENTION

The above objects of the invention, and others, are met by a direct mail article produced from a transparent plastic mailing tube having two solid color plastic end caps. A certificate or other promotional document is provided, having addressee, return address and postage information printed thereon in one quadrant of one side of the certificate. When the certificate is folded along orthogonal fold lines to provide four plies, the side of the quadrant having that mailing information is exposed. The folded certificate may be inserted into the cylindrical tube, displaying the mailing information through the clear plastic of the tube and leaving a gap between the opposite edges of the folded certificate framing a window. The promotional token may be inserted in the tube to be visibly displayed in said window. The assembled mailing tube is of sufficient structural integrity to be transmitted through the mail without an outer wrapper or envelope.

In a preferred embodiment, the certificate is dimensioned to be approximately twice as long as the mailing tube, so that when folded normal to this length it will fit within the length of the tube. The width of the certificate is dimensioned so that, when folded across its width, the resulting dimension will be somewhat shorter than the periphery of the inside wall of the cylindrical tube. When the folded certificate is curled and inserted in the transparent plastic tube, it forms an arcuate plane displaying postal information on its convex side. The arc of the plane thus formed frames a gap between its opposite lineal edges. This gap frames a window allowing display of the promotional token inside the tube. In the preferred embodiment of the invention,

BRIEF DESCRIPTION OF THE DRAWINGS

These and other objects and advantages are attained by the means described herein and disclosed in the accompanying drawings in which.

DETAILED DESCRIPTION OF THE INVENTION

Figure 1:
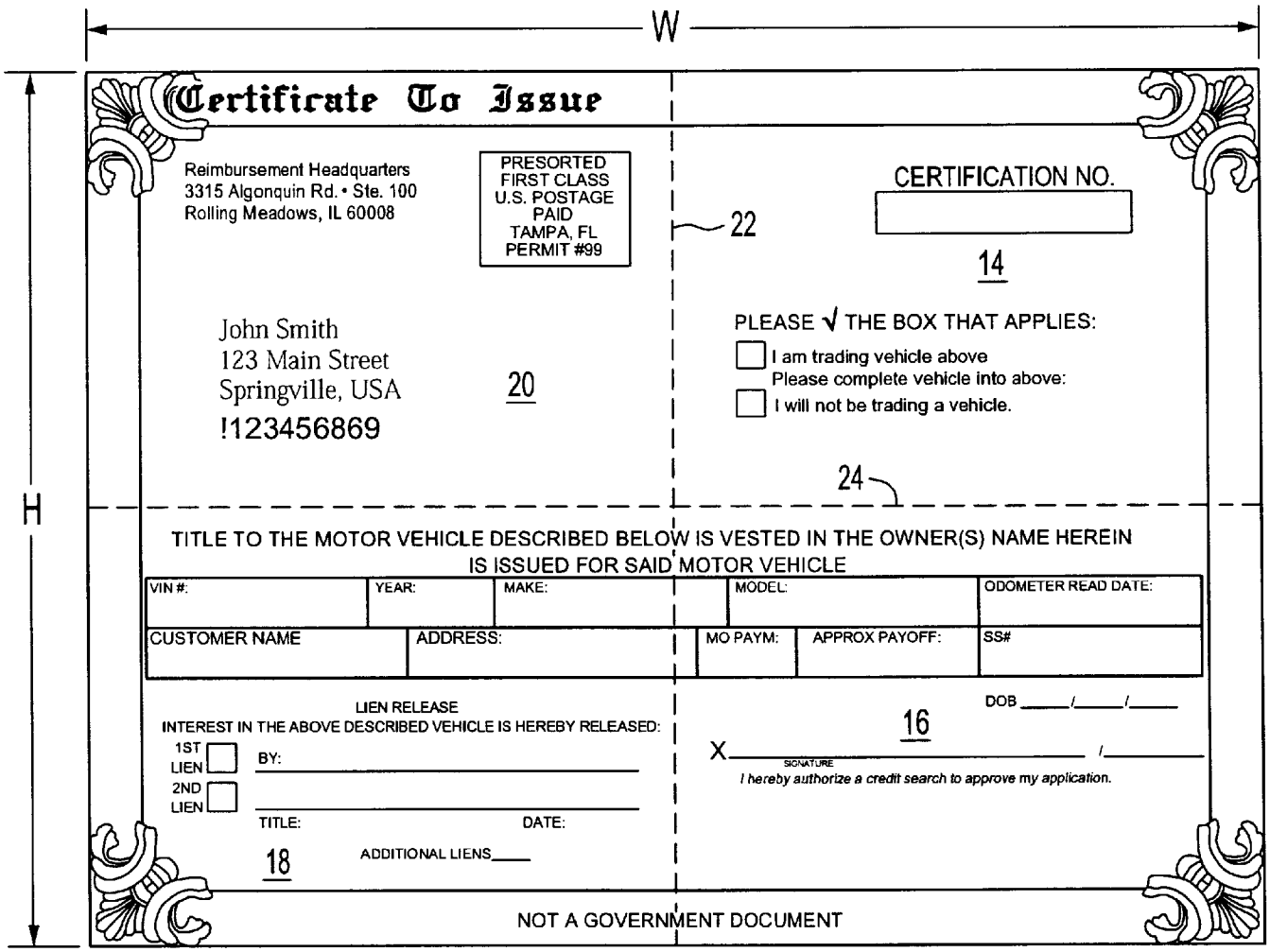
FIG. 1 is a plan view of the certificate component of the preferred embodiment the invention in an unfolded form.

As shown in the plan view of FIG. 1, certificate 10 is divided into first, second, third and fourth panels, preferably quadrants, 14, 16, 18 and 20, respectively, by first and second orthogonally related fold lines 22 and 24, respectively. Particularly, the fold line 22 extends vertically substantially medially between and parallel to the sides of certificate 10 while fold line 24 extends horizontally substantially medially between and parallel to the top and bottom of certificate 10. Consequently, the first and second panels 14 and 16 lie on opposite sides of the fold line 22 from the third and fourth panels 18 and 20. Also, the fourth and first panels 20 and 14 lie on opposite sides of the fold line 24 from the second and third panels 16 and 18, respectively.

As illustrated in FIG. 1, the fourth panel 20 on a first side of certificate 10 may be provided with address information, for example, the address of the recipient 42, the return address of the entity mailing the mailer 44 and postal permit information 46. The remaining panels of the first side of certificate 10, as well as the entire opposite side of the certificate, may be printed with promotional text and graphics. It will be appreciated that panel 20 in FIG. 1 will be exposed to view in the final form of the mailer, whereas printing panels 14, 16 and 18, as well as the opposite side, would be hidden from view in the final form of the mailer.

Figure 2:
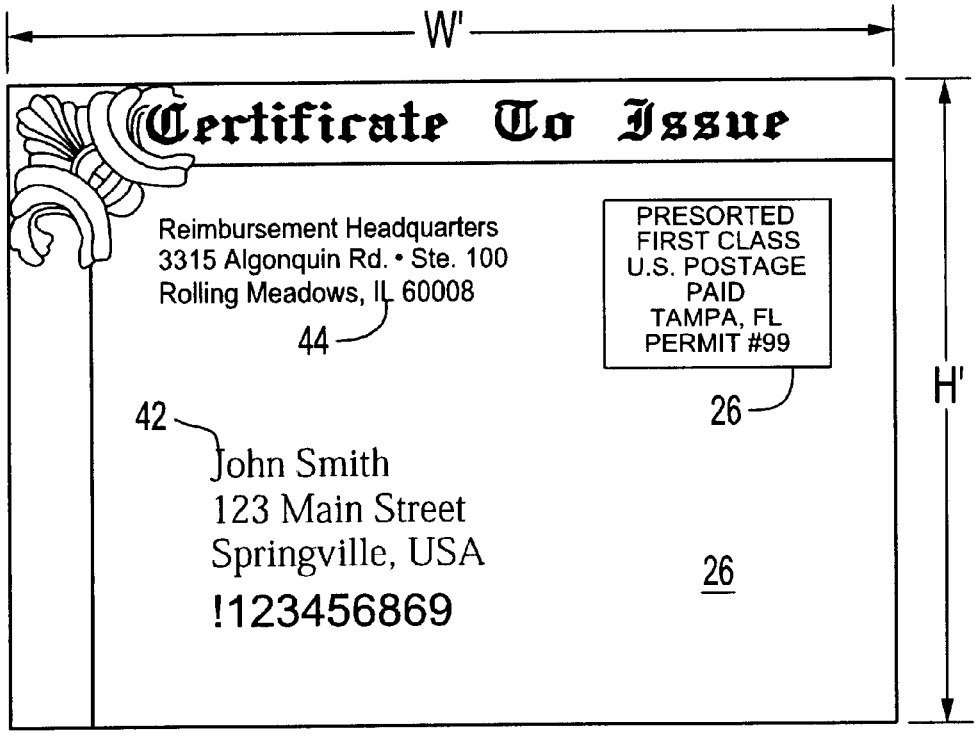
FIG. 2 is a plan view the certificate shown in FIG. 1 folded to expose the address-bearing quadrant of the certificate.

By folding certificate 10 along one of fold lines 22 and 24, and then folding again along the other fold line, a four-ply mailer 26, as illustrated in FIG. 2, is provided. Note that the recipient's address on the face of panel 20 is exposed to view. The resulting dimensions of mailer 26 are indicated as W' and H', which are one-half the dimensions W and H of certificate 10, respectively. One or both of the fold lines 22 and 24 may be provided as a perforated parting line.

Figure 5:
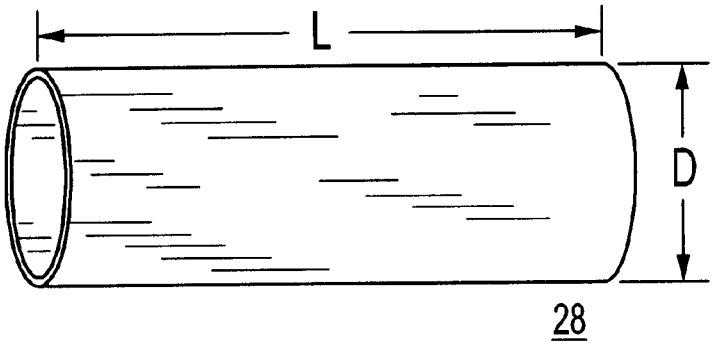
FIG. 5 is a perspective view of the transparent tube component of the preferred embodiment of the present invention.
Figure 6A:
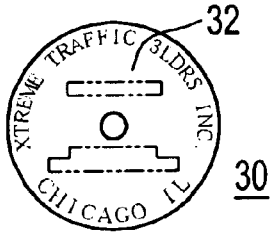
FIGS. 6A–6C are top plan, side plan and perspective views, respectively, of the end cap component of the preferred embodiment of the present invention.
Figure 6B:
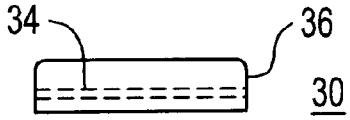
Figure 6C:
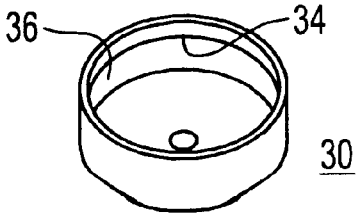

As shown in FIG. 5, transparent cylindrical plastic tube 28 is provided having a length L substantially equal to W' (the width of mailer 26) and a diameter D. Identical end caps 30, shown in detail in FIGS. 6A–6C, are adapted to be press fitted to opposite ends of tube 28. End caps 30 are formed of generally opaque molded thermoplastic material with a molded internal annular grip ring 34 on the interior of cap wall 36. When the caps are fitted to the ends of tube 28 flexible wall 36 spreads slightly to tightly grip the end of tube 28. In this manner, the tube is securely capped to survive the rigors of normal mail handling. End caps 30 have promotional information 32 displayed thereon, such as trademarks, the identity of the direct mail marketing company and a toll-free number.

As shown in FIG. 5, tube 28 has diameter D, and the tube circumference=$\Pi \times D$. In the preferred embodiment, tube 28 is 1.5 inches in diameter and 4 inches long. The circumference of tube 28 is approximately 4.7 inches. Certificate 10 has a width W of 8 inches and a height H of 6 inches. When folded, as previously described, four-ply mailer 26 has a width W' of 4 inches and a height H' of 3 inches.

Figure 4:
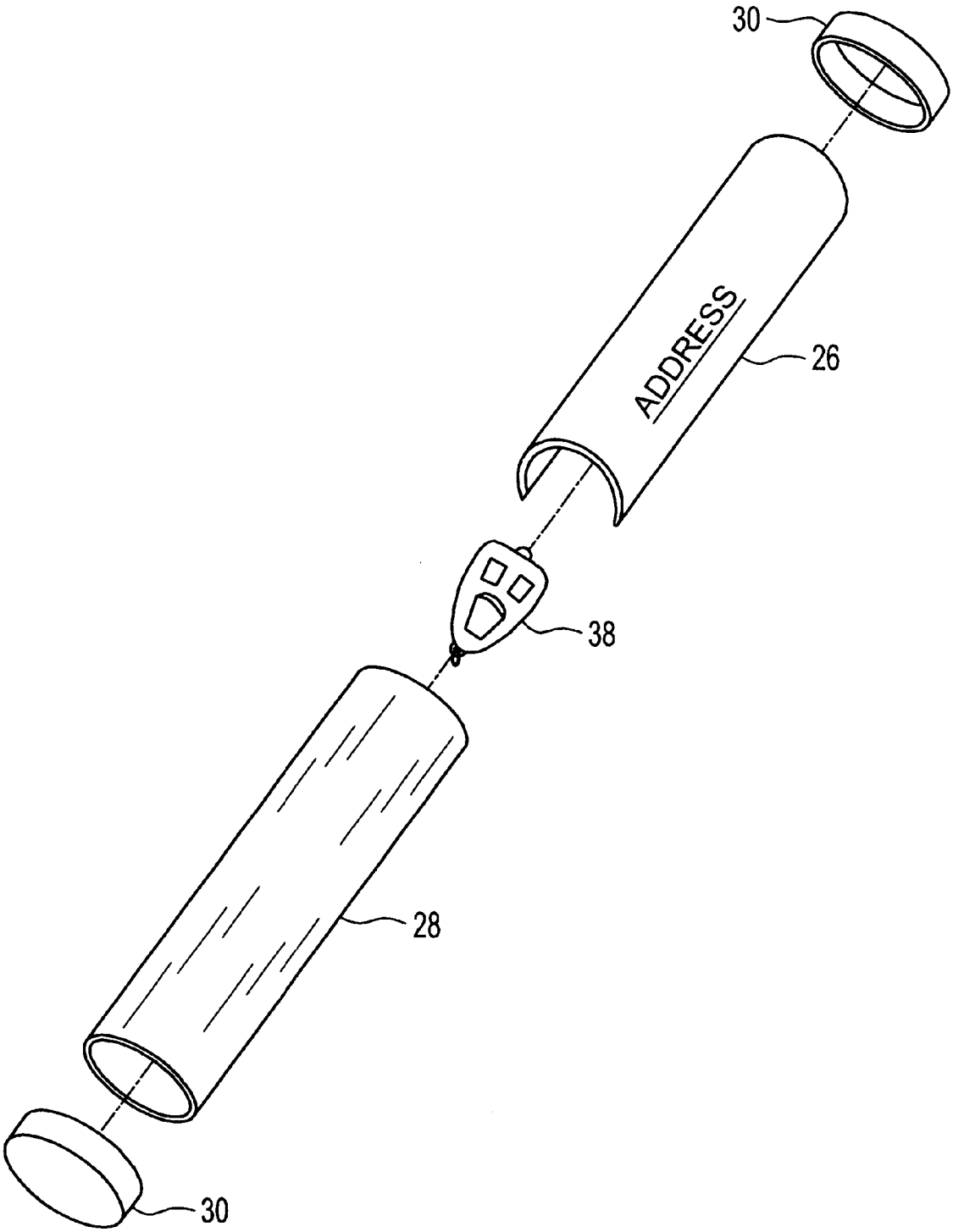
FIG. 4 is a generally perspective exploded view of the components of the preferred embodiment of the invention.

As shown in FIG. 4, mailer 26 is inserted into tube 28 by curling mailer 26 to fit inside tube 28. Since mailer height H' is 1.7 inches shorter than tube circumference C, the curled mailer presents a gap G between the edges of curled mailer 26.

After curled mailer 26 is inserted into clear tube 28, one end cap 30 is press-fitted to one end of tube 28. A game or promotional token 38 is inserted into tube 28. Finally, the other end cap 32 is press-fitted to the other end of tube 28 to secure the assembly during transmission in the mails. Token 38 is displayed in the window formed by gap G through transparent tube 28.

Figure 3A:
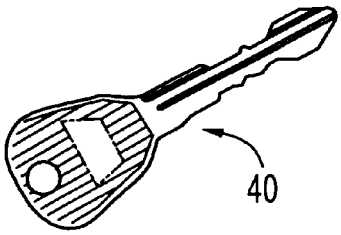
FIG. 3A is a perspective view of a key token component of one embodiment of the invention.
Figure 3B:
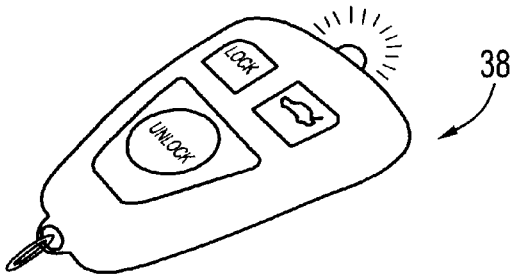
FIG. 3B is a perspective view of the configuration of an automotive keyless entry key fob token component of the preferred embodiment of the invention.

Token 38 is shown in FIG. 3B in the preferred embodiment of this invention as the configuration of an automotive keyless entry key fob. This token may be coded to unlock or solve a game that can only be played at the sponsoring dealership's location. This token may be fitted with a light-emitting diode to be used as a key ring flashlight. Alternatively, the packaged token may be in the form of key 40, shown in FIG. 3A, that may be used as a game token to open a lock at the dealership and win a prize.

The direct mail package just described provides several distinct benefits. In the preferred embodiment, it provides a dimensional mailer that is light in weight to qualify for a low postal rate. Its maximum dimensions can be determined in accordance with the requirements of the postal service for such postal rates. It is easily inspected by the recipient so as to allay any fear of unsolicited mail and, further, to pique the recipient's curiosity as to the token within the tube.

While only one embodiment of the invention has been shown, it should be apparent to those skilled in the art that what has been described is considered at present to be the preferred form of the applicants' invention. The invention illustrated and described in detail in the drawings and foregoing description is to be considered as illustrative and not restrictive in character, and not limited to any particular field of use. For example, the invention described herein is not intended to be limited to the specific field of direct mail marketing. Those skilled in the art should understand that various modifications can be made to the illustrated embodiment without departing from the scope of the invention as described in the specification and hereafter defined in the appended claims.

We claim:

1. A direct mail article comprising:

a transparent semi-rigid mailing cylinder enclosing an interior volume and having a first end and a second end, having a uniform diameter dimension from said first end to said second end, a uniform internal circumference dimension and a length dimension measurable from said first end to said second end and an internal curvature;

a printed quadrate promotional enclosure having a first side and a second side, a top edge and a bottom edge, and having a width dimension substantially equal to the length of said cylinder and having a height dimension less than said uniform internal circumference dimension and greater than said diameter dimension;

whereby, when said promotional enclosure is inserted in said tube for mailing, said enclosure is deformed to substantially conform to the internal curvature of the tube and defining a gap between said top edge and said bottom edge allowing visual access into said interior volume.

2. A direct mail article as in claim 1, wherein said first side has postal information printed thereon, and is deformed upon insertion into said tube so that said first side is convex.

3. A direct mail article as in claim 1, further comprising a pair of end caps adapted to be fitted to the first and second ends of said tube to secure the article during transmission in the mails.

4. A direct mail article as in claim 3, wherein each of said end caps comprises a circular base and a circular wall normal to the plane of said base and having a circular ridge on the inside of said wall parallel to said base, whereby, when said cap is fitted to said tube, said ridge grips said tube to secure the article during transmission in the mails.

5. A direct mail article as in claim 3, wherein each of said end caps has promotional information thereon.

6. A direct mail article as in claim 1, wherein said printed quadrate promotional enclosure is formed from a quadrate ply having first and second faces;

first and second orthogonal fold lines separating said ply into first, second, third and fourth quadrants, said first and third quadrants diagonally dispose with respect to each other, said first and second quadrants separated by said second fold line, and said first and fourth quadrants separated by said first fold lines, and each of said quadrants of said quadrants having two free edges;

and said quadrate ply is folded along one of said fold lines and then along the other of said fold lines to form a four-ply quadrate.

7. A direct mail article as in claim 6, further comprising address information on said first quadrant.

8. A direct mail article as in claim 7, wherein said quadrate ply has a first side and a second side, a top edge and a bottom edge, and having a width dimension substantially equal to twice the length of said cylinder and having a height dimension less than twice said uniform internal circumference dimension and greater than twice said diameter dimension;

whereby, when said promotional enclosure is inserted in said tube for mailing, said enclosure is deformed to substantially conform to the internal curvature of the tube and defining a gap between said top edge and said bottom edge allowing visual access into said interior volume and is deformed upon insertion into said tube so that said first quadrant is convex.

9. A direct mail article as in claim 6, wherein at least one of said fold lines is a perforated parting line.

10. A direct mail article as in claim 1, further comprising a promotional token disposed within said interior volume.

11. A direct mail article as in claim 10, wherein said token closely resembles an automotive keyless entry remote control unit.

12. A direct mail article as in claim 10, wherein said token is a key.

* * * * *